US011139126B2

(12) United States Patent
Pohle

(10) Patent No.: US 11,139,126 B2
(45) Date of Patent: Oct. 5, 2021

(54) METHOD FOR THE PRODUCTION A SOLID-INSULATED CIRCUIT-BREAKER POLE

(71) Applicant: Siemens Aktiengesellschaft, Munich (DE)

(72) Inventor: Dirk Pohle, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 231 days.

(21) Appl. No.: 15/313,119

(22) PCT Filed: May 12, 2015

(86) PCT No.: PCT/EP2015/060471
§ 371 (c)(1),
(2) Date: Nov. 22, 2016

(87) PCT Pub. No.: WO2015/185335
PCT Pub. Date: Dec. 10, 2015

(65) Prior Publication Data

US 2017/0207039 A1 Jul. 20, 2017

(30) Foreign Application Priority Data

Jun. 4, 2014 (DE) ..... 102014210587.0

(51) Int. Cl.
*H01H 11/00* (2006.01)
*H01H 33/662* (2006.01)
*H01H 9/02* (2006.01)

(52) U.S. Cl.
CPC ..... *H01H 11/00* (2013.01); *H01H 33/662* (2013.01); *H01H 33/66207* (2013.01);
(Continued)

(58) Field of Classification Search
CPC ..... H01H 11/00; H01H 33/662; H01H 33/66207; H01H 33/666; H01H 2009/0285; H01H 2033/6623
See application file for complete search history.

(56) References Cited

U.S. PATENT DOCUMENTS 3,471,669 A * 10/1969 Curtis ..... H01H 9/04 200/302.1
3,812,314 A * 5/1974 Nonken ..... H01B 17/005 218/138

(Continued)

FOREIGN PATENT DOCUMENTS

CN 1328740 C 7/2007
DE 19906972 A1 8/2000

(Continued)

OTHER PUBLICATIONS

International Search Report and Written Opinion dated Jul. 27, 2015.

(Continued)

*Primary Examiner* — Peter Dungba Vo
*Assistant Examiner* — Jeffrey T Carley
(74) *Attorney, Agent, or Firm* — Harness, Dickey & Pierce, P.L.C.

(57) ABSTRACT

A method for producing a solid-insulated circuit-breaker pole includes forming a pole shell housing with an elastic layer that is integrally joined to the pole shell housing; and mounting a vacuum fault interrupter into the pole shell housing provided with the elastic layer. Also disclosed is a solid-insulated circuit-breaker pole.

10 Claims, 1 Drawing Sheet

(52) U.S. Cl.
CPC ..... *H01H 2009/0285* (2013.01); *H01H 2033/6623* (2013.01)

(56) References Cited

U.S. PATENT DOCUMENTS

| | | | | | |
|---|---|---|---|---|---|
| 3,955,167 | A * | 5/1976 | Kumbera | H01H 85/042 | 337/188 |
| 5,521,348 | A * | 5/1996 | Berndt | H01H 33/666 | 218/119 |
| 5,717,185 | A * | 2/1998 | Smith | H01H 33/666 | 218/154 |
| 5,912,604 | A * | 6/1999 | Harvey | H01H 33/6662 | 218/138 |
| 8,178,812 | B2 * | 5/2012 | Martin | H01H 33/66207 | 218/118 |
| 8,350,174 | B2 * | 1/2013 | Gentsch | H01H 9/52 | 218/124 |
| 9,325,104 | B2 * | 4/2016 | Siebens | H01R 43/18 | |
| 2004/0061589 | A1 * | 4/2004 | Daharsh | H01C 7/12 | 338/21 |
| 2005/0029001 | A1 * | 2/2005 | Sato | H01B 3/02 | 174/50 |
| 2006/0011589 | A1 * | 1/2006 | Hering | H01H 33/66207 | 218/118 |
| 2007/0278187 | A1 * | 12/2007 | Siebens | H01H 33/66207 | 218/118 |
| 2007/0293073 | A1 * | 12/2007 | Hughes | H01H 33/66207 | 439/187 |
| 2008/0142485 | A1 * | 6/2008 | Gentsch | B29C 45/14639 | 218/118 |
| 2008/0217148 | A1 * | 9/2008 | Kowalyshen | H01H 11/0031 | 200/17 R |
| 2010/0078302 | A1 * | 4/2010 | Erk | H01H 33/666 | 200/400 |

FOREIGN PATENT DOCUMENTS

| | | | | |
|---|---|---|---|---|
| EP | 2613333 | A1 | 7/2013 | |
| JP | 2018147643 | A * | 9/2018 | H01H 33/027 |
| WO | WO 0041199 | A1 | 7/2000 | |
| WO | WO-2004035738 | A1 | 5/2004 | |
| WO | WO 2004038748 | A1 | 5/2004 | |

OTHER PUBLICATIONS

Chinese Office Action dated Jan. 24, 2018.

Office Action for German Patent Application No. 10 2014 210 587.0 dated Feb. 16, 2021 and English translation thereof.

* cited by examiner

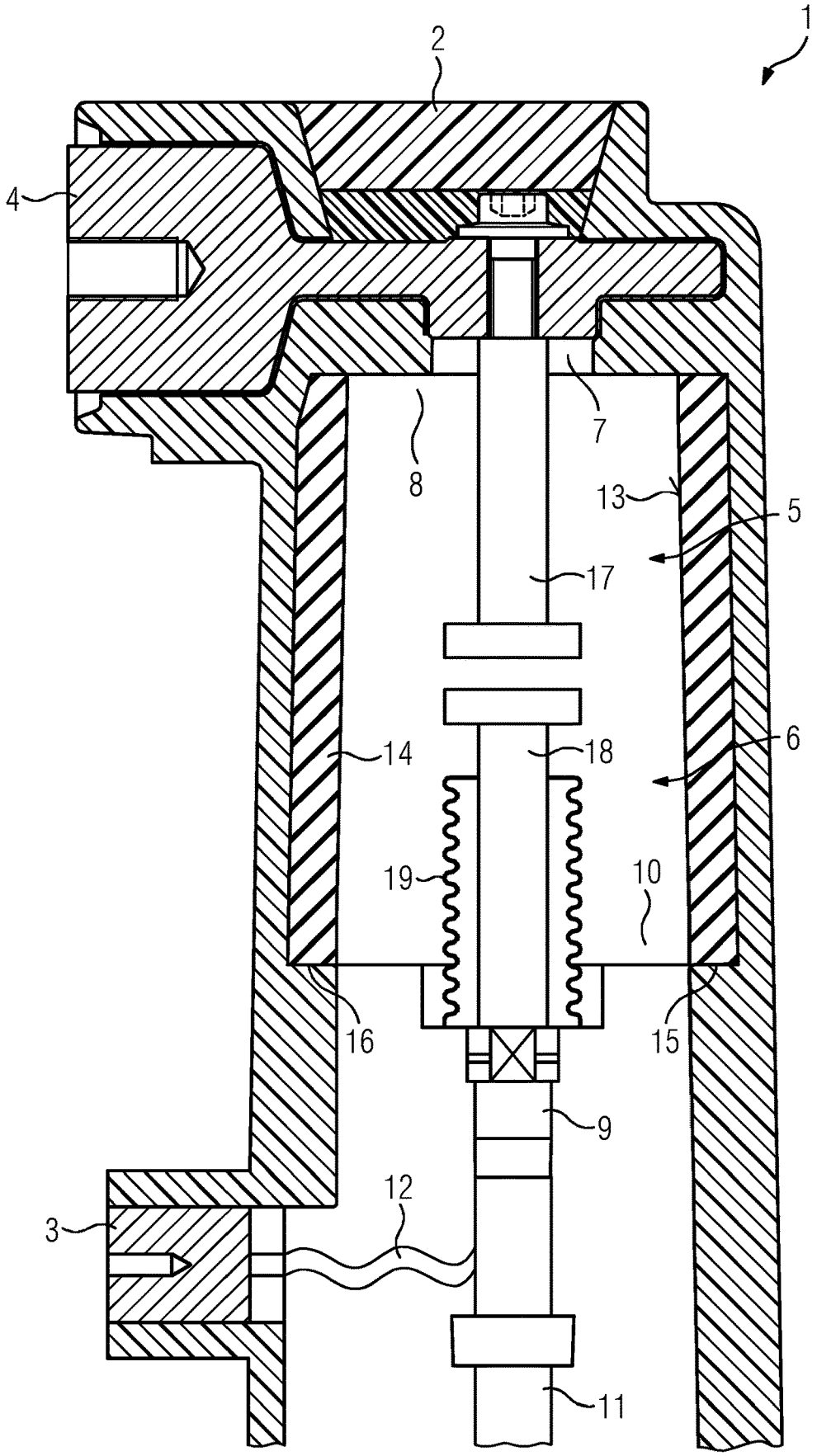
1
2
4
7
8
13
5
17
14
18
6
19
10
16
15
9
12
3
11

METHOD FOR THE PRODUCTION A SOLID-INSULATED CIRCUIT-BREAKER POLE

PRIORITY STATEMENT

This application is the national phase under 35 U.S.C. § 371 of PCT International Application No. PCT/EP2015/060471 which has an International filing date of May 12, 2015, which designated the United States of America and which claims priority to German patent application number DE 102014210587.0 filed Jun. 4, 2014, the entire contents of which are hereby incorporated herein by reference.

FIELD

An embodiment of the invention generally relates to a method for producing a solid-insulated circuit-breaker pole.

BACKGROUND

A method of is disclosed by way of example in WO 2004/038748 A1 and comprises the steps:

Forming a pole shell housing,

Mounting a vacuum interrupter in the pole shell housing and

Filling an intermediate space between the pole shell housing and the mounted vacuum interrupter with a fluid compensating compound that cures after being poured and as a consequence becomes a gel-type or rubber-type material.

The fluid compensating compound is provided for the purpose of compensating for differences in the thermal expansion coefficients of the pole shell housing and the vacuum interrupter or the housing of the vacuum interrupter in that an elastic padding layer is formed between the pole shell housing and the vacuum interrupter by way of the cured fluid compensating compound. The pole shell housing is generally embodied by way of example from a synthetic material that is stable for a long time, by way of example from thermosetting plastic (for example epoxy resin) or a thermoplastic (for example polyamide) or a composite material or the like. The vacuum interrupter is arranged as a switching element of a circuit breaker that is generally embodied in a multi-phase manner, by way of example a medium voltage circuit breaker, in the pole shell housing so as to provide dielectric insulation, wherein the pole shell housing comprises connectors and a current that is to be connected via the vacuum interrupter is supplied by way of the connectors. The elastic padding layer thereby also has the task of insulating the two connectors and must therefore comprise a sufficient dielectric resistance.

SUMMARY

An embodiment of the present invention provides a method for producing a solid-insulated circuit-breaker pole that is simple and cost-effective to produce.

In an embodiment of the invention, a method is for producing a solid-insulated circuit-breaker pole, the method comprises:

Forming a pole shell housing with an elastic layer that is connected to the pole shell housing in an integrally bonded manner, Mounting a vacuum interrupter in the pole shell housing that is provided with the elastic layer.

Furthermore, at least one embodiment of the invention relates to a solid-insulated circuit-breaker pole.

BRIEF DESCRIPTION OF THE DRAWINGS

The invention is further explained hereinunder with reference to an example embodiment and the drawing, the single FIGURE illustrates a schematic view of an example embodiment of a solid-insulated circuit-breaker pole in accordance with the invention.

The FIGURE illustrates an example embodiment of a solid-insulated circuit-breaker pole.

DETAILED DESCRIPTION OF THE EXAMPLE EMBODIMENTS

In an embodiment of the invention, a method is for producing a solid-insulated circuit-breaker pole, the method comprises:

Forming a pole shell housing with an elastic layer that is connected to the pole shell housing in an integrally bonded manner, Mounting a vacuum interrupter in the pole shell housing that is provided with the elastic layer.

In other words, in the method in accordance with an embodiment of the invention in an advantageous manner initially the pole shell housing is formed completely with an elastic layer in the housing, the layer being connected to the pole shell housing, so that the pole shell housing can be produced or pre-produced together with the elastic layer that is connected in an integrally bonded manner as a padding and independently of the vacuum interrupter, and to further form the solid-insulated circuit-breaker pole it is subsequently merely necessary to assemble the vacuum interrupter in the region of the pole shell or the pole shell housing that is provided with the elastic layer. Consequently, the pole shell housing is formed with the elastic layer as an integral component of the pole shell housing. The term "integrally bonded" within the scope of the present invention also includes being adhered to one another in a particularly strong manner, by way of example by compatible materials.

In an advantageous embodiment of the method in accordance with the invention, the forming of the pole shell housing with the elastic layer that is connected to the pole shell housing in an integrally bonded manner comprises:

Forming the elastic layer; and

Attaching the pole shell housing to the elastic layer in an integrally bonded manner.

In an embodiment of the method of this type, the elastic layer is initially formed as a separate, dedicated component that is then surrounded in the next step by the pole shell housing.

In another advantageous embodiment of the method in accordance with the invention, the forming of the pole shell housing with the elastic layer that is connected to the pole shell housing in an integrally bonded manner comprises:

Forming the pole shell housing, and

Introducing the elastic layer into the pole shell housing in an integrally bonded manner.

In the case of an embodiment of this method, the pole shell housing is initially formed and is subsequently provided with the elastic layer.

It is possible to connect the elastic layer and pole shell housing in an integrally bonded manner in different ways, by way of example via an injection molding method or particularly advantageously via a two-component injection molding method in which the elastic layer is injection molded on in the first method step and in the second step the pole shell housing is injection molded onto the elastic layer, the pole shell housing being embodied from a solid synthetic material that is stable for a long time, or conversely the pole shell housing is produced in the first step and the elastic layer is then injection molded into the pole shell housing in the second step.

It is possible to introduce the elastic layer into the pole shell housing in an integrally bonded manner in different ways, by way of example via spraying or adhering the elastic layer into the pole shell housing, the pole shell housing by way of example being embodied from epoxy resin or polyamide.

Suitable materials for the elastic layer are by way of example thermoplastic elastomers, silicone rubber or EPDM, wherein where appropriate the strength of the connection between the elastic layer and the pole shell housing can be further improved by way of a suitable chemical or physical pretreatment.

The elastic layer that is connected to the pole shell housing in an integrally bonded manner can surround the vacuum interrupter or can in part surround a housing wall region of the vacuum interrupter. A sufficiently elastic padding is provided between the vacuum interrupter and the pole shell housing by completely surrounding the vacuum interrupter or also in part surrounding a housing wall region of the vacuum interrupter and by way of the padding it is possible to compensate for the differences in the thermal expansion coefficients of the vacuum interrupter and the pole shell housing and simultaneously the dielectric insulation of the connectors is ensured.

A solid-insulated circuit breaker pole is disclosed in WO 2004/038748 A1, and comprises a pole shell housing having a first connector, a second connector, a vacuum interrupter and also an elastic layer.

An embodiment of the present invention is to further form a solid-insulated circuit-breaker pole of the above-described type, the circuit breaker pole being simple and cost-effective to produce.

This is achieved in accordance with an embodiment of the invention by way of a solid-insulated circuit-breaker pole of the type described above by virtue of the fact that the elastic layer is connected to the pole shell housing in accordance with a method according to any one of the above embodiments.

The FIGURE illustrates a solid-insulated circuit-breaker pole 1 that comprises a pole shell housing 2 that is preferably formed in a casting method from an epoxy resin or a similar material that forms a fixed pole shell housing. A first connector 3 and also a second connector 4 are provided on the solid-insulated circuit-breaker pole 1, the connectors being provided so as to connect to parts of a circuit-breaker system that guide current and are not further illustrated in the figure and a circuit-breaker having one or multiple solid-insulated circuit-breaker poles 1 of this type.

A vacuum interrupter 5 is arranged between the first connector 3 and the second connector 4, the vacuum interrupter comprising a fixed contact 17 and also a moving contact 18 with a bellows 19 within a housing 6, wherein the fixed contact is connected in an electrically conductive manner to the second connector 4 by way of a fixed contact connecting bolt 7 that extends through a first metal housing part 8, and the moving contact is connected in an electrically conductive manner to the first connector 3 by way of a moving contact connecting bolt 9 that extends through a second metal housing part 10. The moving contact connecting bolt 9 is mechanically coupled by way of an insulating switching rod 11 to a drive system that is likewise not further illustrated in the figure so as to initiate a drive movement so as to close or open the contact system of the fixed contact and moving contact of the vacuum interrupter 5, and the moving contact connecting bolt is connected in an electrically conductive manner to the first connector 3 via a flexible conductor 12.

A housing wall region 13 of the housing 6 of the vacuum interrupter 5 that is typically embodied as a ceramic cylinder is completely surrounded by an elastic layer 14 in the example embodiment. However, within the scope of the present invention it can also be sufficient merely to surround in part the housing wall region 13 via the elastic layer 14, wherein the term "in part" within the scope of the invention means in relation to the axial extent of the elastic layer 14 over the housing wall region 13 of the housing 6 of the vacuum interrupter 5.

In the example embodiment in the FIGURE, the pole shell housing 2 comprises undercuts 15, 16 in such a manner that the pole shell housing 2 comprises a smaller inner diameter outside the region of the elastic layer 14 than in the region of the elastic layer. This is in particular advantageous if at first the elastic layer 14 is formed as a molded part and the pole shell housing is subsequently arranged around the molded part of the elastic layer by way of casting or injection molding. The undercuts 15, 16 are however optional and are not absolutely necessary.

The elastic layer 14 is connected in an integrally bonded manner to the pole shell housing 2 of the solid-insulated circuit-breaker pole 1, by way of example by introducing the elastic layer 14 into the pole shell housing 2 or by way of attaching the pole shell housing 2 to the pre-produced elastic layer 14 so that in particular it is possible to assemble the vacuum interrupter 5 in the pole shell housing that is provided with the elastic layer 14. The elastic layer 14 ensures that the expansion fluctuations are compensated for, the expansion fluctuations occurring owing to the different temperature expansion coefficients of the vacuum interrupter 5 and in particular the housing 6 of the vacuum interrupter 5 and the pole shell housing 2, and also the required dielectric insulation.

By way of example, thermoplastic elastomers, silicones, polyurethane or EPDM are possible as material for the elastic layer 14, wherein the elastic layer 14 can be introduced by way of example via adhesion in the pole shell housing 2.

LIST OF REFERENCE NUMERALS

1 Solid-insulated circuit-breaker pole
2 Pole shell housing
3 First connector
4 Second connector
5 Vacuum interrupter
6 Housing
7 Fixed contact connecting bolt
8 First metal housing part
9 Moving contact connecting bolt
10 Second metal housing part
11 Insulating switching rod
12 Flexible conductor
13 Housing wall region
14 Elastic layer
15 Undercut
16 Undercut

The invention claimed is:

1. A method for producing a solid-insulated circuit-breaker pole, comprising:

forming a pole shell housing with an elastic layer contained within an interior surface of the pole shell housing, the elastic layer being connected to the pole shell housing in an integrally bonded manner; and after forming the pole shell housing with the elastic layer on the interior surface of the pole shell housing, mounting a vacuum interrupter having a vacuum interrupter housing defined by a wall region, a first metal housing part and a second metal housing part and having a fixed contact and a movable contact within the vacuum interrupter housing, in the pole shell housing such that the elastic layer is in direct surface contact with a surface of the vacuum interrupter and is between the pole shell housing and the vacuum interrupter, wherein the forming comprises:

forming the elastic layer; and attaching the pole shell housing to the elastic layer in an integrally bonded manner.

2. The method of claim 1, wherein the elastic layer is connected to the pole shell housing in an integrally bonded manner via an injection molding method.

3. The method of claim 1, wherein a thermoplastic elastomer forms the elastic layer.

4. The method of claim 1, wherein silicone rubber forms the elastic layer.

5. The method of claim 1, wherein EPDM forms the elastic layer.

6. The method of claim 1, wherein the elastic layer, connected to the pole shell housing in an integrally bonded manner, surrounds the vacuum interrupter.

7. The method of claim 1, wherein the elastic layer, connected in an integral manner to the pole shell housing, surrounds in part a housing wall region of the vacuum interrupter.

8. The method of claim 1, wherein the elastic layer is formed as a separate, dedicated component prior to being surrounding by the pole shell housing.

9. The method of claim 1, wherein the forming of the pole shell housing includes forming undercuts in an inner surface of the pole shell housing such that the pole shell housing has a smaller inner diameter outside a region of the elastic layer than in a region of the elastic layer.

10. The method of claim 1, wherein the forming of the pole shell housing includes molding a thermosetting plastic or a thermoplastic to form the pole shell housing.

* * * * *